United States Patent [19]

Drumm

[11] Patent Number: 4,754,714

[45] Date of Patent: Jul. 5, 1988

[54] TABLETOP CONNECTION APPARATUS

[75] Inventor: Edward J. Drumm, Murfreesboro, Tenn.

[73] Assignee: Samsonite Furniture Company, Murfreesboro, Tenn.

[21] Appl. No.: 97,540

[22] Filed: Sep. 16, 1987

[51] Int. Cl.[4] ..... A47B 3/06

[52] U.S. Cl. ..... 108/157; 108/159; 403/24

[58] Field of Search ..... 108/157, 159, 150; 248/431, 432, 164; 403/24

[56] References Cited

U.S. PATENT DOCUMENTS

| | | | |
|---|---|---|---|
| 3,215,097 | 11/1965 | Bedol | 108/159 |
| 3,215,381 | 11/1965 | Ching | 108/157 X |
| 3,312,355 | 4/1967 | Steinmetz | 248/188 X |
| 3,366,079 | 1/1968 | Koransky | 108/157 |
| 3,643,608 | 2/1972 | DeCesaris | 248/431 X |
| 3,910,206 | 10/1975 | Jay | 108/159 |
| 4,315,467 | 2/1982 | Vanderminden | 108/157 |
| 4,467,730 | 8/1984 | Borichevsky | 108/159 |
| 4,503,780 | 3/1985 | Apissomian | 108/27 |
| 4,624,598 | 11/1986 | Gabriel et al. | 108/150 X |

FOREIGN PATENT DOCUMENTS

| | | | |
|---|---|---|---|
| 874952 | 3/1953 | Fed. Rep. of Germany | 108/159 |
| 1202523 | 1/1960 | France . | |

*Primary Examiner*—Peter A. Aschenbrenner
*Attorney, Agent, or Firm*—Steve Rosenblatt

[57] ABSTRACT

An apparatus for connecting a tabletop to support legs is disclosed featuring a connector having a flexible tail. A closure having a mounting bead is superimposed over the connector which is mounted to the end of each table leg. An interference fit between the connector and the closure fixes the position of the tabletop with respect to the support legs.

11 Claims, 2 Drawing Sheets

TABLETOP CONNECTION APPARATUS

FIELD OF THE INVENTION

The field of this invention relates to connectors generally and specifically connectors as used to connect table tops to support frames.

BACKGROUND OF THE INVENTION

Connectors have been in use in furniture design for many years. Various connection devices have been proposed to attach tabletops to support frames. Some of these connection systems were fairly complex, requiring a variety of assembly tools as well as considerable amount of time to make the connection between a table top and a supporting frame. In U.S. Pat. No. 3,366,079 each leg of the frame had to be individually inserted into an appropriate slot at the edge of the tabletop. Following insertion of each of the table legs, a central bracket had to be connected to fix the position of all of the table legs with respect to each other. Each leg was further secured in position by virture of an interaction between a depression on the upper end of each leg and a detent built into the tabletop.

French Pat. No. 1,202,253 made public Jan. 11, 1960, discloses a tabletop having a plurality of hook-shaped elements which are brought into engagement with a frame and then screwed into the tabletop to fix the position of the tabletop with respect to the frame.

U.S. Pat. No. 4,503,780 issued Mar. 12, 1985 discloses a furniture construction, such as a table, and a method for attaching a closed loop stretchable edging to a rigid rim of the table. The method involves a fairly complex stretching apparatus to stretch the edging to a size greater than the perimeter of the rim of the tabletop. The tabletop is then placed within the stretched loop and the stretching apparatus is disengaged permitting the edging to retract and elastically engage the rim. The edging includes a flexible upper lip which is pulled back to permit a tabletop panel to be positioned under the lip. When the lip is allowed to retract the lip engages the edge portion of the tabletop panel securing the tabletop panel to the rim of the table.

U.S. Pat. No. 3,215,097 shows a plurality of support legs to support a tabletop. The tabletop has a built in bead 15 and abutment 28. Each of the legs has a leg locking head 22 mounted on its end. The head 22 is made of plastic and has a heel 25 which is positioned against abutment 28 and the toe 26 extending in the opposite direction from heel 25. When the tabletop is placed upside down on the support surface and each leg is pushed toward the tabletop, the toe 26 flexes over the bead 15 and locks into place behind it. When the table is turned right side up, the weight of the table is held principally due to the interaction between heel 25 and abutment 28. As a result of the contact between heel 25 and abutment 28 and the contact between toe 26 and rim 14, the position of the tabletop is fixed. It should be noted that when the table is turned right side up there is only contact between toe 26 and the innerface of rim 14. the weight of the tabletop is on heels 25.

The Finkel Company sells a quick connect system using a rigid plastic connector having a projection thereon. The projection extends through a notch in a closure. The tabletop is secured when the closure is rotated moving the projection out of alignment from the notch.

It is an object of this invention to provide for a simple snap connecting apparatus for attaching two members together preferably a tabletop to support legs.

It is further object of this invention to provide an apparatus that can be simply assembled and disassembled without the use of special tools or the like and can be assembled and disassembled relatively quickly.

SUMMARY OF THE INVENTION

An apparatus for connecting a tabletop to support legs is disclosed featuring a connector having a flexible tail. A closure having a mounting bead is superimposed over the connector which is mounted to the end of each table leg. An interference fit between the connector and the closure fixes the position of the tabletop with respect to the support legs.

BRIEF DESCRIPTION OF THE DRAWINGS

As seen in FIG. 1 the apparatus A of the present invention comprises a tabletop T that can be made from glass or acrylic or other suitable supporting materials. The frame F comprises of a plurality of support legs 10 which preferably extend in a horizontal direction parallel and contact with tabletop T. Any number of such legs 10 can be used depending on the size of the table. The support legs 10 are preferably of a tubular construction having an open end 12. A connector C is adapted for insertion into the open end 12 of each support leg 10.

FIGS. 3 and 4 illustrate the connector C in more detail. As shown in FIG. 4 the tabletop T is in contact with horizontal surface 14 and adjacent vertical surface 16. Extension surface 14 is preferably disposed of in a plane parallel to the outer surface 18 of support legs 10. As seen in FIG. 1, extension surface 14 extends beyond each support leg 10.

Each connector C also preferably has a tabletop centering surface 16. Thus when a connector C is assembled to each support leg 10, the tabletop T can be placed within a geometric shape defined by tabletop centering surfaces 16 of each connector. It should be noted that tabletop centering surface 16 can be eliminated from connector C without departing from the spirit of the invention. In that situation, the closure D can be placed adjacent to tabletop and surface 20 on closure D can be positioned adjacent to the edge of the tabletop T.

Figure 1:
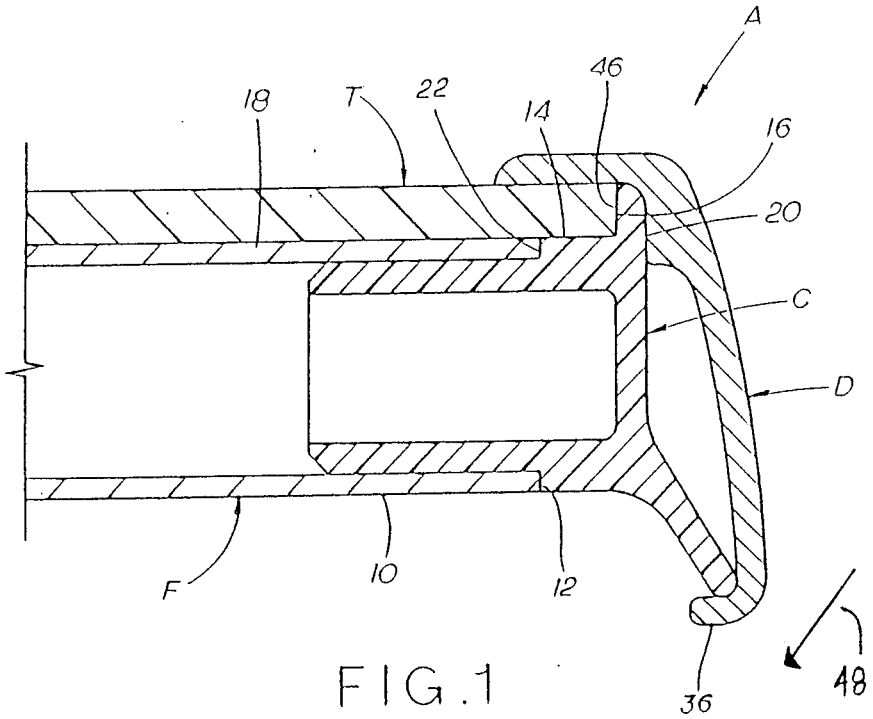
FIG. 1 is a sectional view showing the closure mounted to the connector.
Figure 3:
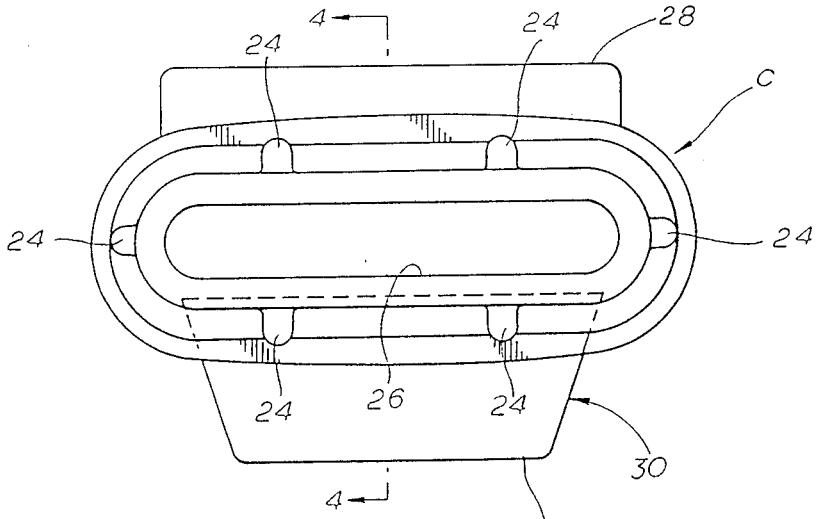
FIG. 3 is a front view of the connector.
Figure 4:
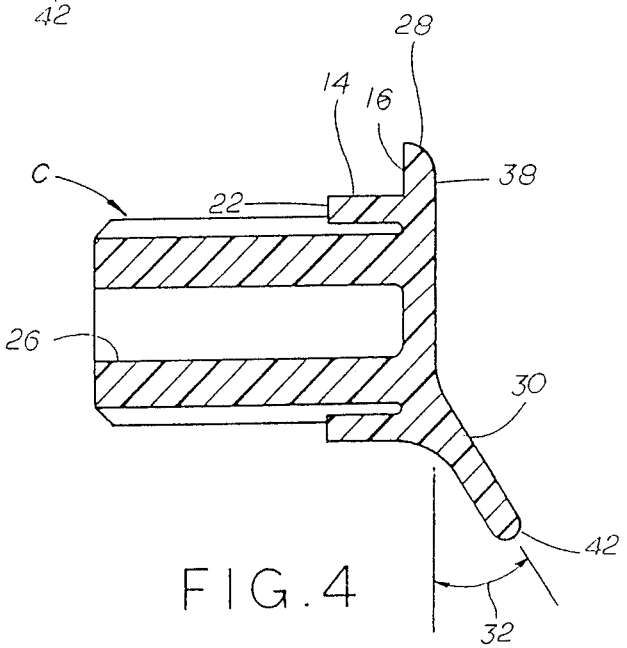
FIG. 4 is a section view taken through lines 4–4 of FIG. 3.

Each support leg 10 can have any desired cross-section such as round square or oval. In the preferred embodiment an oval cross-section gives a more light looking appearance and is desirable when the furntirue is used for outdoor or patio use. As shown in FIG. 1, connector C can have a mounting shoulder 22 which essentially acts as a travel stop when the connector C is inserted into the open end 12 of support leg 10. After complete insertion of the connector C into support leg 10, the outer surface 18 of support leg 10 should be in substantial alignment with extension surface 14. Alternatively, as shown in FIGS. 3 and 4, a somewhat different design can be employed on the connector C. As shown in FIGS. 3 and 4, there is still a mounting shoulder 22 which acts as the travel stop for the connector C. However, to facilitate manufacturing of the connector C and easy installation into support legs 10, which may have an oval configuration, a plurality of projections 24 are dispoed around the periphery of the body 26 of connector C. The body 26 of connector C is that portion which is inserted into the open edn 12 of support leg 10. The use of a plurality of projections 24 facilitates the insertion of the connector C into the open end 12 of support leg 10. Thus dimensional differences due to manufacturing tolerances can be easily dealt with by use of the projections 24.

Connector C has a top surface 28. A flexible tail 30 extends in a direction away from the tabletop preferably at an included angle of about 30–45 degrees measured from the vertical axis as indicated by arrow 32.

Figure 5:
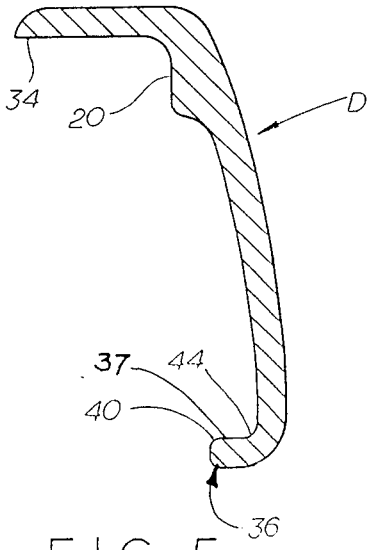
FIG. 5 is a section view of the closure. Detailed description of the preferred embodiment.

As seen in FIG. 5, the closure D has a tabletop engagement surface 34 and a mounting bead 36 disposed at the opposite end. Mounting bead 36 further comprises a tail retaining surface 37 which preferably is parallel to tabletop engagement surface 34 Surface 20 (FIG. 5) is designed to back up to surface 38 of connector C (FIG. 4).

It should be noted that connector C is preferably made from a resilient plastic material. The resiliency predominately of flexible tail 30 comes into play due to the interference fit between closure D and connector C. As seen in FIG. 5, the shortest distance between tabletop engaging surfaces 34 and knuckle 40 of bead 36 is less than the shortest dimension between top surface 28 and end point 42 on connector C. (FIG. 4)

Closure D is preferably a one piece construction which is made preferably from grade 6063-T52 aluminum. Closure D conforms to the shape of tabletop T and is made to be installed over connector C after a connector is mounted to each support leg 10.

When installing the closure D over connector C initial engagement is achieved between tabletop engaging surface 34 on closure D and top surface 28 of connector C. Almost simultaneously tabletop engaging surface 34 also preferably contacts the tabletop T which has previously been placed into position on top of support legs 10. Additionally, each connector C has been placed into an open end 12 of each support leg 10 prior to placement of tabletop T on support legs 10. Alternatively, the closure D can be set on a flat support surface. The tabletop T is then lowered into positin within closure D. Then, each support leg 10, having a connector C mounted to its open end 12, is pushed down against closure D until tail 30 flexes over knuckle 40 and the connection is complete.

Due to the interference fit, after contact between tabletop engaging surface 34 and the tabletop T and/or top surface 28, end point 42 extends beyond knuckle 40. It is at this point that the flexibility of tail 30 comes into play as further downward forces are exerted on closure D. As a result of such further downward forces, knuckle 40 is literally pushed beyond end point 42 all the while displacing end point 42 as tail 30 flexes. At a certain point, tail 30 has flexed to an extent sufficient to permit end point 42 to clear knuckle 40. At this time, tail 30 flexes in the opposite direction to extend into contact with radius 44 (FIG. 5).

Thus when end point 42 is in contact with radius 44, connector C is preferably but not necessarily, under a compressive load within closure D thereby precluding accidental disengagement of tail 30 from bead 36.

It should be noted that with the closure D firmly in place over all the connectors C mounted to each support leg 10, that the weight of the tabletop T is substantially on all of the support legs 10. Although there may be contact between the tabletop T and extension surface 14 of connector C, as shown in FIG. 1, substantially all of the weight of the tabletop is taken up by support legs 10. When fully assembled, as shown in FIG. 1, the edge 46 of tabletop T is encapsulated by tabletop engaging surface 34, tabletop centering surface 16 and extension surface 14. Preferably, tabletop engaging surface 34 is in continuous contact with tabletop T as shown in FIG. 1.

The closure D can be disconnected from connector C by applying sufficient force to tail 30 in the direction of arrow 48 as shown in FIG. 1.

Figure 2:
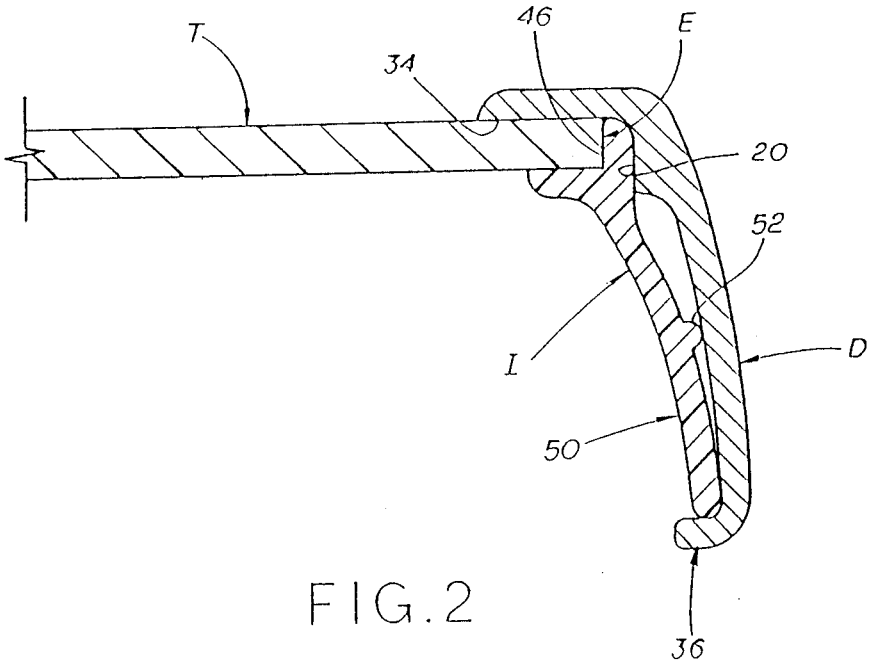
FIG. 2 is a section showing an intermediate connector with a closure mounted to it for use in tabletops requiring additional support between the support legs.

As shown in FIG. 2, some tables, due to the size, weight or composition of the tabletop T require intermediate support between support legs 10 (not shown in FIG. 2). Accordingly, an intermediate connector I is used between support legs 10 along the periphery 46 of tabletop T. Intermediate connector I has engagement means E at one end. The balance of intermediate connector I comprises a tail 50. A projection 52 is disposed longitudinally along intermediate connector I and serves two functions. Projection 52 acts as a travel stop or bumper when closure D is applied over intermediate connector I. Additionally, projection 52 acts as a longitudinal stiffener to tail 50 to keep it from over flexing.

In applications requiring intermediate connector I, the engagement means E is placed into contact with the tabletop after the closure D is already connected to all connectors C. The tail 50 is then flexed over the knuckle 40 completing the connection. The interaction between intermediate connector I and closure D is similar to that previously described for connector C. As a result intermediate connectors I provides support along the edge of the table top by virtue of their interaction with continuous closure D.

As can readily be seen, the tabletop T can be easily connected to the support legs 10 quickly and without the use of special tools. The connection is sturdy and need not bear the bulk of the weight of the tabletop which is taken up by support legs 10. The connector C also provides a simply way to center the tabletop with respect to the support legs 10 prior to engaging the connector D. The assembly when fully connected as shown in FIG. 1 provides a functional as well as aesthetically pleasing apparatus for securing the tabletop T to the support legs 10.

It should be understood that although connector C has been described as a separate component insertable into the open end 12 of support legs 10, that the structure of connector C can be made integral with each support leg 10 without departing from the spirit of the invention.

The foregoing disclosure and description of the invention is illustrative and explanatory thereof, and various changes in the size, shape and materials as well as in the details of the illustrated construction may be made without departing from the spirit of the invention.

What I claim is:

1. An apparatus for fixing the position of a tabletop with respect to a supporting frame, having a plurality of supporting legs, comprising:

a connector mounted to a supporting leg further comprising:

a flexible tail extending away from the tabletop; and a closure circumscribing the tabletop and adapted to be mounted to said connector, said closure comprising;

a tabletop engagement surface selectively engageable to said connector; and a mounting bead disposed at the opposite end of said closure from said tabletop engagement surface, said mounting bead further comprising a tail retaining surface;

whereupon as said tabletop engagement surface is brought into initial contact with said connector, there is an interference fit between said flexible tail and said mounting bead; and each said tail flexing, upon further movement of said closure, to pass over said bead, whereupon each said tail flexes back towards said bead retaining surface with said closure trapping said connector including its tail between said tabletop engagement surface and said bead retaining surface.

2. The apparatus of claim 1 wherein:

said connectors each further comprise a tabletop centering surface extending in a plane tangent to the edge of the tabletop;

said tabletop engagement surface of said closure spanning over said tabletop centering surface.

3. The apparatus of claim wherein:

said connectors each further comprise an extension surface extending beyond and substantially parallel to the outer surface of each support leg, said extension surface disposed between said tabletop centering surface and the end of each support leg;

whereupon substantially all the weight of the tabletop is supported directly by the support legs and the periphery of the tabletop at each connector is encapsuated by said tabletop engagement surface, said tabletop centering surface, and said extension surface.

4. The apparatus of claim wherein:

said tabletop engagement surface is generally tangent with the top surface of the tabletop around its entire periphery.

5. The apparatus of claim wherein each connection further comprises:

a mounting shoulder disposed on the opposite end of said extension surface from said tabletop centering surface said mounting shoulder acting as a travel stop when each connector is inserted into a tubular support leg.

6. The appartus of claim 5 wherein:

each said flexible tail extends downwardly away from the tabletop in a plane displaced about 30–45 degrees from vertical.

7. The apparatus of claim wherein said closure is an aluminum extrusion.

8. The apparatus of claim further comprising:

at least one intermediate connector disposed at the periphery of the tabletop between and unconnected to the support legs and comprising:

a flexible tail; and engagement means for connecting the intermediate connector to the tabletop;

whereupon when said tabletop engagement surface of said closure is brought into initial contact with said engagement means there is an interference fit between said tail on said intermediate connector and said mounting bead;

said tail on said intermediate connector flexing upon further movement of said connector to pass over said bead, whereupon said tail on said intermediate connector flexes back and into contact with said bead retaining surface with said closure retaining said intermediate connector, including its tail, under compressive load between said tabletop engagement surface and said bead retaining surface.

9. The apparatus of claim wherein:

said intermediate connector further comprising a tabletop centering surface extending in the plane parallel to the tabletop;

said tabletop engagement surface of said closure spanning over said tabletop centering surface on said intermediate connector.

10. The apparatus of claim wherein:

said intermediate connector further comprises a tabletop support surface disposed adjacent to said tabletop centering surface on said intermediate connector.

whereupon the periphery of the tabletop at each intermediate connector is encapsulated by said tabletop engagement surface of said closure and said tabletop centering and support surfaces of said intermediate connector.

11. The apparatus of claim further comprising:

a projection on said tail disposed between the engagement means of said intermediate connector and the free end of said tail of said intermediate connector, said projection engaging said closure when said closure is snapped over said intermediate connector.

* * * * *